US009101251B1

(12) United States Patent
Moorhouse

(10) Patent No.: US 9,101,251 B1
(45) Date of Patent: Aug. 11, 2015

(54) MULTIFUNCTION HANDY DRYER

(71) Applicant: Brett E. Moorhouse, Boynton Beach, FL (US)

(72) Inventor: Brett E. Moorhouse, Boynton Beach, FL (US)

( * ) Notice: Subject to any disclaimer, the term of this patent is extended or adjusted under 35 U.S.C. 154(b) by 410 days.

(21) Appl. No.: 13/724,013

(22) Filed: Dec. 21, 2012

(51) Int. Cl.

| | |
|---|---|
| ***A47K 10/48*** | (2006.01) |
| ***A45D 20/14*** | (2006.01) |
| ***F26B 21/06*** | (2006.01) |
| ***F26B 9/10*** | (2006.01) |
| *A45D 20/16* | (2006.01) |
| *F26B 21/00* | (2006.01) |
| *F26B 9/00* | (2006.01) |

(52) U.S. Cl.
CPC ..... *A47K 10/48* (2013.01); *F26B 21/06* (2013.01); *A45D 20/14* (2013.01); *A45D 20/16* (2013.01); *F26B 9/003* (2013.01); *F26B 21/001* (2013.01)

(58) Field of Classification Search
CPC ..... A47K 10/48; A47K 10/485; A45D 20/00; A45D 20/04; A45D 20/08; A45D 20/14; A45D 20/16; F26B 21/001; F26B 9/003
USPC ..... 34/90, 97, 98; 392/380, 381; 219/222
See application file for complete search history.

(56) References Cited

U.S. PATENT DOCUMENTS

| | | | | | |
|---|---|---|---|---|---|
| 1,419,712 | A | * | 6/1922 | Bassette | 392/381 |
| 2,651,705 | A | * | 9/1953 | Clemens | 392/381 |
| 2,698,894 | A | * | 1/1955 | Stein | 392/380 |
| 2,714,151 | A | * | 7/1955 | Becker | 392/381 |
| 2,853,591 | A | * | 9/1958 | Fine | 392/381 |
| 3,878,621 | A | * | 4/1975 | Duerre | 34/90 |
| 4,195,416 | A | * | 4/1980 | Hall | 34/90 |
| 4,642,909 | A | * | 2/1987 | Garcia | 34/97 |
| 4,665,630 | A | * | 5/1987 | Postbeschild | 34/566 |
| 4,707,933 | A | * | 11/1987 | Keck et al. | 34/97 |
| 4,802,287 | A | * | 2/1989 | Chen | 34/91 |
| 5,177,879 | A | * | 1/1993 | Muta | 34/97 |
| 5,351,417 | A | * | 10/1994 | Rubin | 34/90 |
| 5,404,419 | A | * | 4/1995 | Artis, Jr. | 392/381 |
| 5,438,763 | A | * | 8/1995 | Yang | 34/90 |
| 5,442,867 | A | * | 8/1995 | Robinson | 34/90 |
| D380,818 | S | | 7/1997 | Yue | |
| 5,832,624 | A | | 11/1998 | Narrin | |
| 2008/0216339 | A1 | | 9/2008 | Gray | |

* cited by examiner

*Primary Examiner* — David J Laux

(57) ABSTRACT

The present invention features a handy dryer. The handy dryer comprises housing mountable to a wall or pole. Within the housing are a blower, an air divider and two air outlets. The air divider is adjustable to direct the blower air output through a damper between the air outlets. The first outlet is a blower spout with outlet vent circularly rotatable. The second outlet is an adjustable deflector with air flow direction regulated by vent level. The blower is powered by a built-in replaceable battery pack, which is rechargeable by external power source through a power adaptor jack. The blower can be activated within a pre-determined period by pressing a timer button, which is disposed on the housing and operatively engaged to an activator switch on the blower.

8 Claims, 9 Drawing Sheets

(Crossectional View from back showing Inside of Case)

(Bottom View)

(Front View)

(Side View)

(Crossectional View from back showing Inside of Case)

(Iso View of Blow Dryer & Batteries)

(Crossectional View from back of Commercial Version)

(Crossectional View from back of Commercial Version)

MULTIFUNCTION HANDY DRYER

FIELD OF THE INVENTION

The present invention related to a multifunction handy dryer, and more particularly to a multifunction handy dryer with rechargeable battery power and twin adjustable air outlets.

BACKGROUND OF THE INVENTION

Many residential homes store hair dryers under a sink in a cabinet or a drawer. They take up a lot of space and it is usually tangled up in everything when you need it. Hotels motels and country clubs that supply hairdryers have them mounted on the wall with the cord all twisted up and they are not very attractive looking. The Handy Hair Dryer is not only a hair dryer but also a hand dryer and a nightlight all wrapped up in one attractive and neatly packaged casing. The Handy Hair Dryer will also help reduce clutter and be a little greener.

Any feature or combination of features described herein are included within the scope of the present invention provided that the features included in any such combination are not mutually inconsistent as will be apparent from the context this specification, and the knowledge of one of ordinary skill in the art. Additional advantages and aspects of the present invention are apparent in the following detailed description and claims.

SUMMARY OF THE INVENTION

The present invention features a handy dryer. The handy dryer comprises housing mountable to a wall or pole. Within the housing are a blower, an air divider and two air outlets. The air divider is adjustable to direct the blower air output through a damper between the air outlets. The first outlet is a blower spout with outlet vent circularly rotatable. The second outlet is an adjustable deflector with air flow direction regulated by vent level. The blower is powered by a built-in replaceable battery pack, which is rechargeable by external power source through a power adaptor jack. The blower can be activated within a pre-determined period by pressing a timer button, which is disposed on the housing and operatively engaged to an activator switch on the blower.

DESCRIPTION OF PREFERRED EMBODIMENTS

Figure 1:
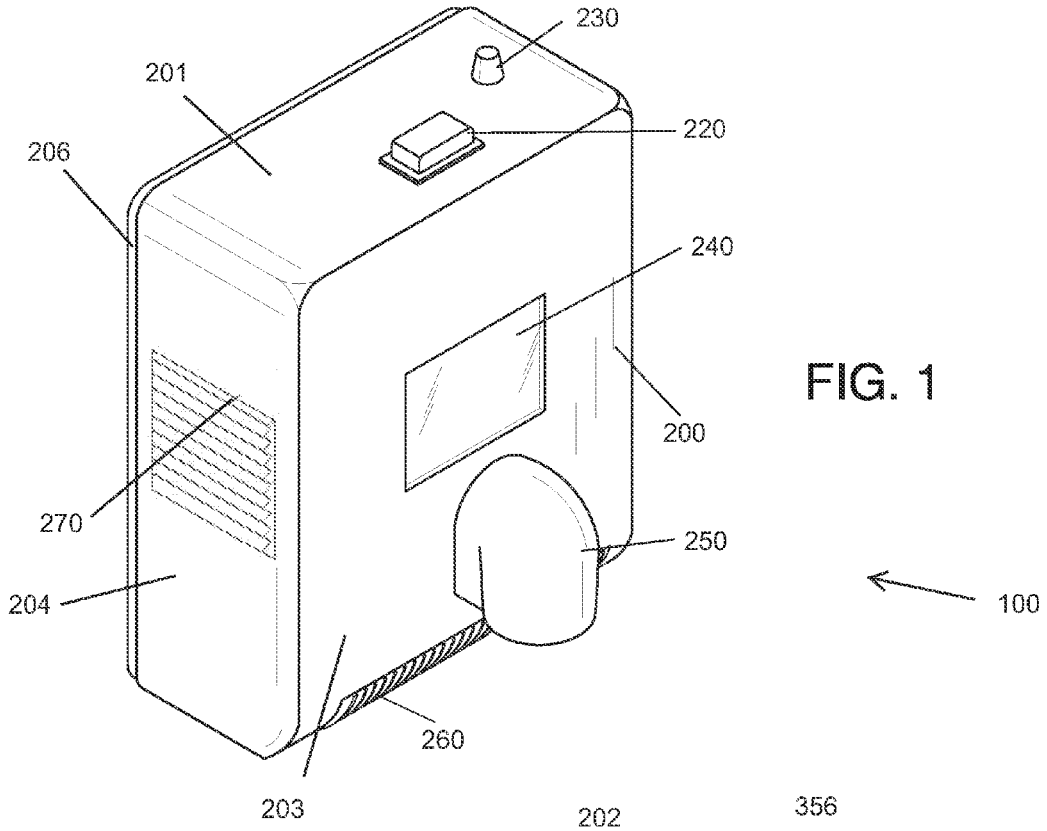
FIG. 1 shows an isometric view of the handy dryer.
Figure 2:
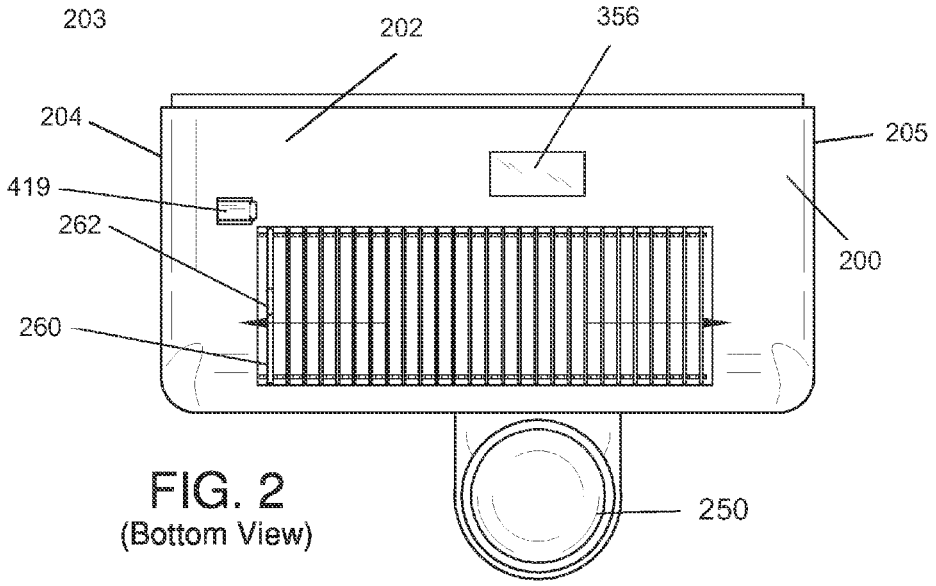
FIG. 2 shows a bottom view of the handy dryer.
Figure 3:
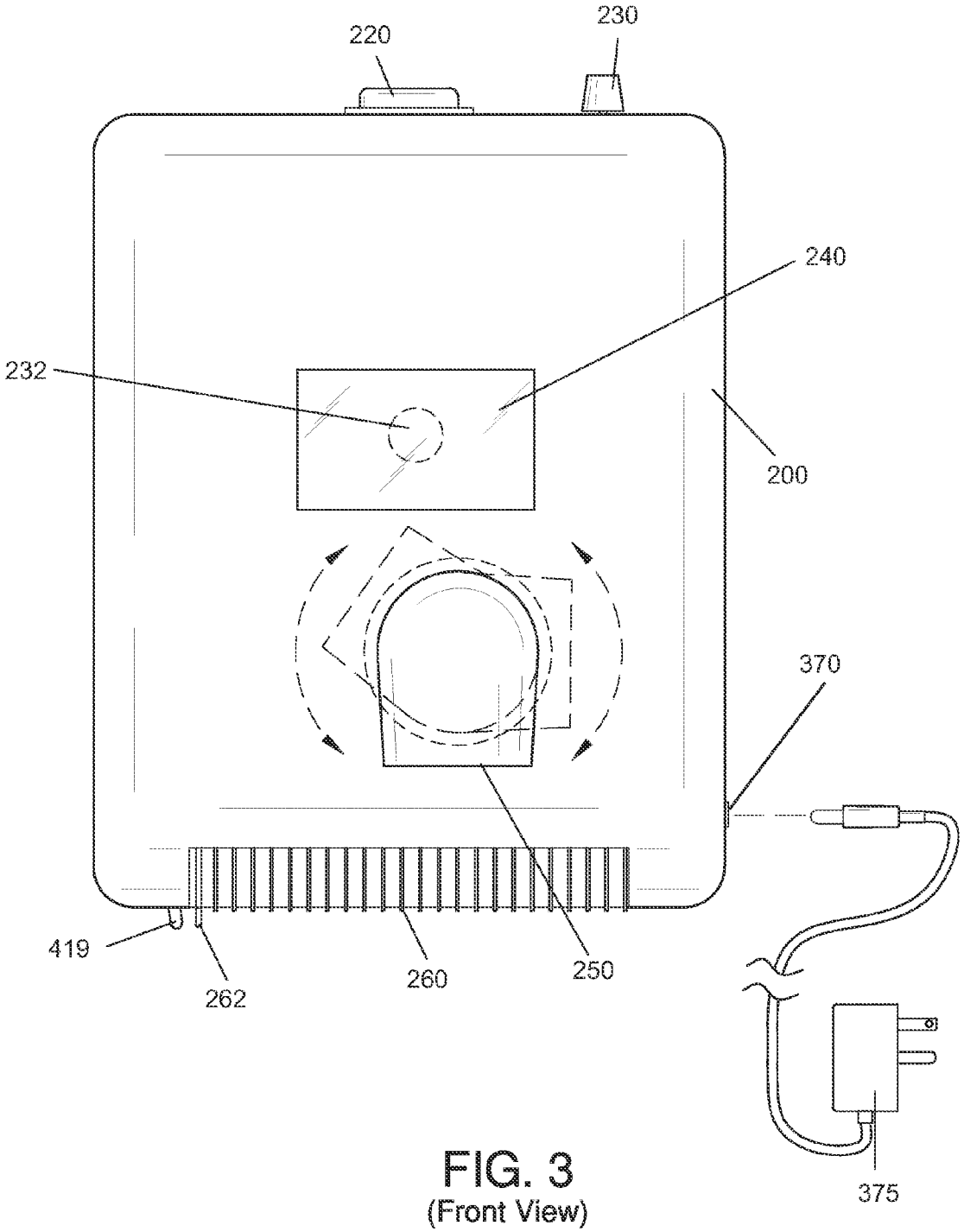
FIG. 3 shows a front view of the handy dryer.
Figure 4:
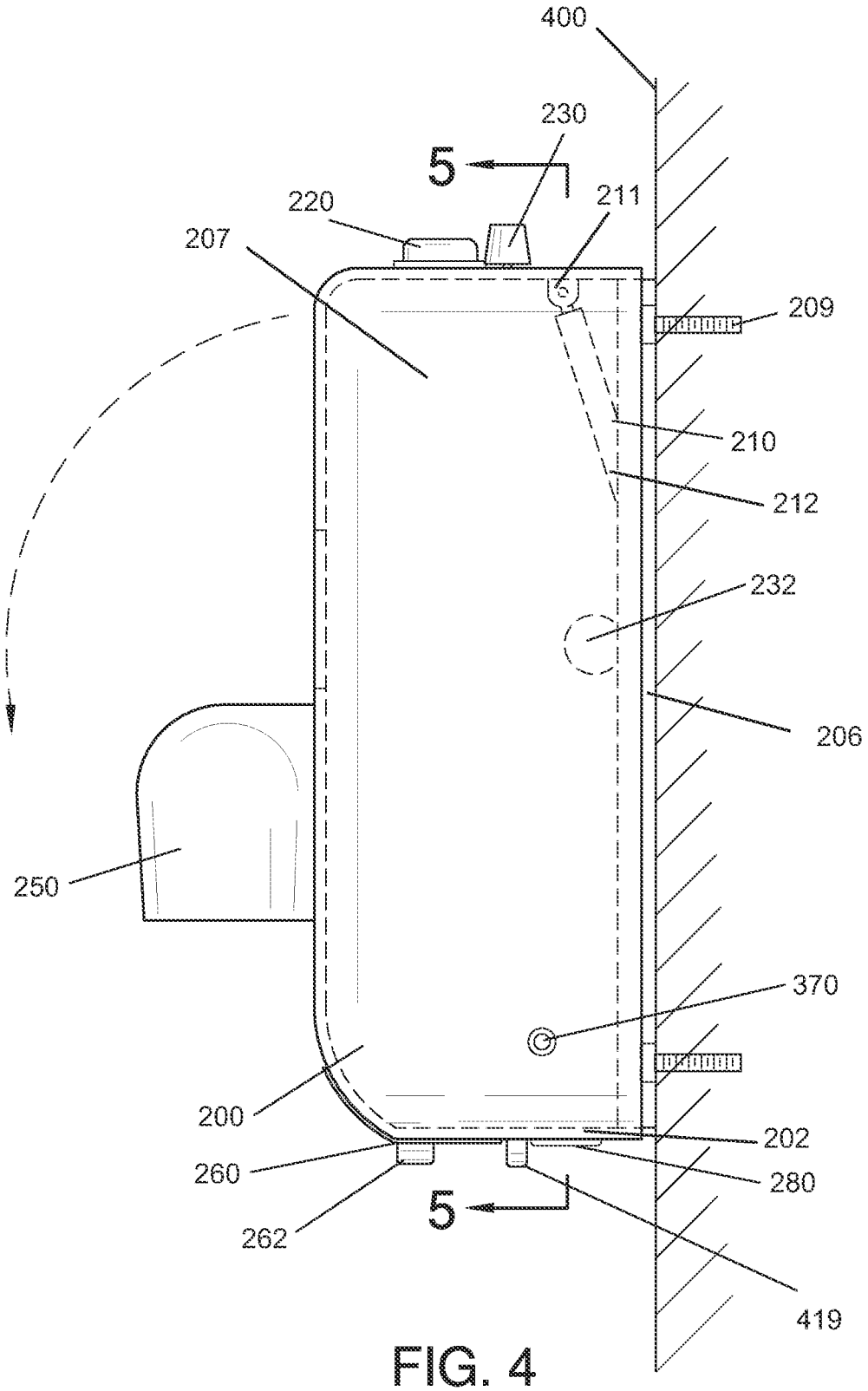
FIG. 4 shows a side view of the handy dryer.
Figure 5:
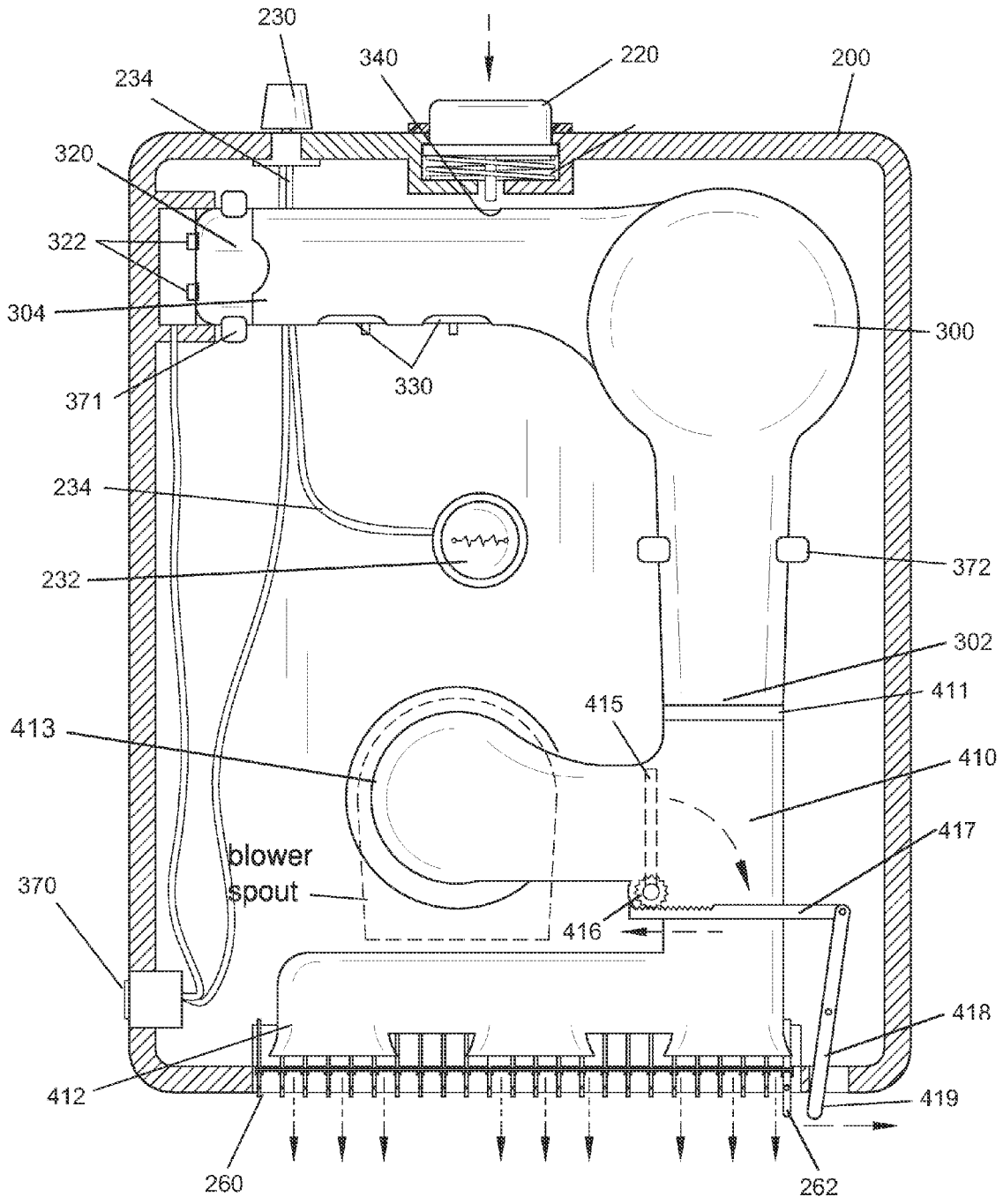
FIG. 5 shows a cross-section view of the handy dryer from back.
Figure 6:
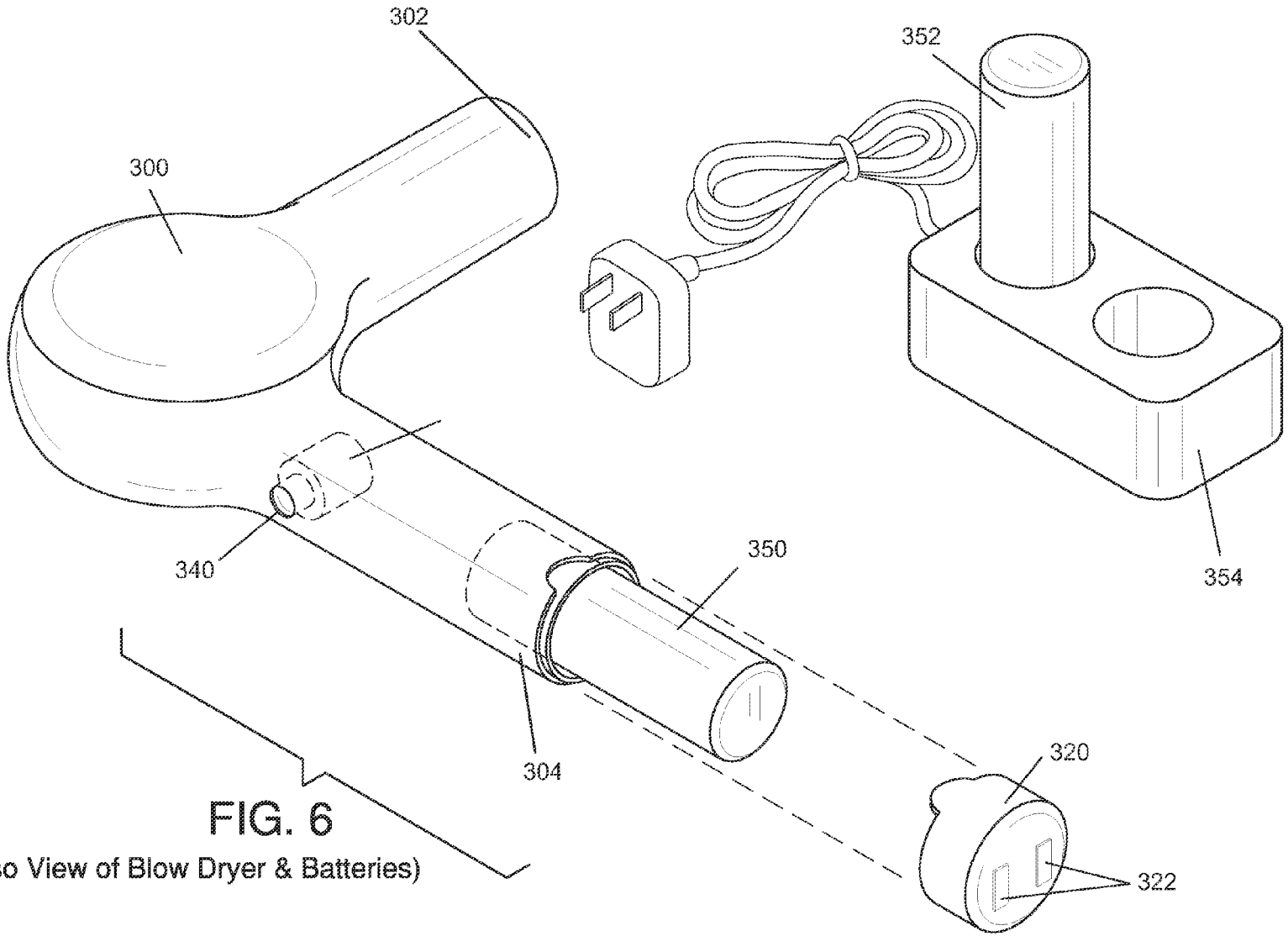
FIG. 6 shows an isometric view of the blower and batteries.
Figure 7:
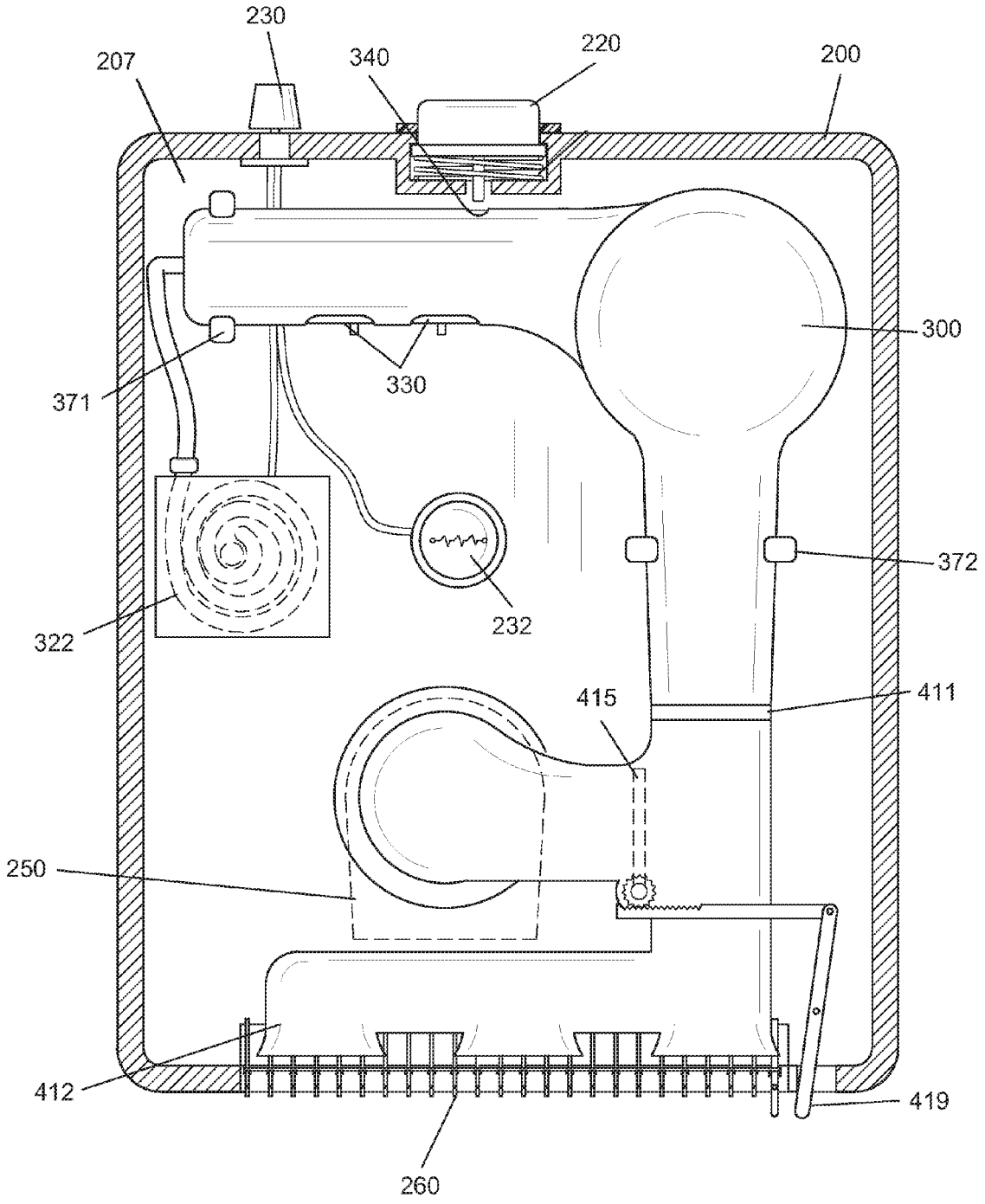
FIG. 7 shows an alternative cross-section view of the handy dryer from back.
Figure 8:
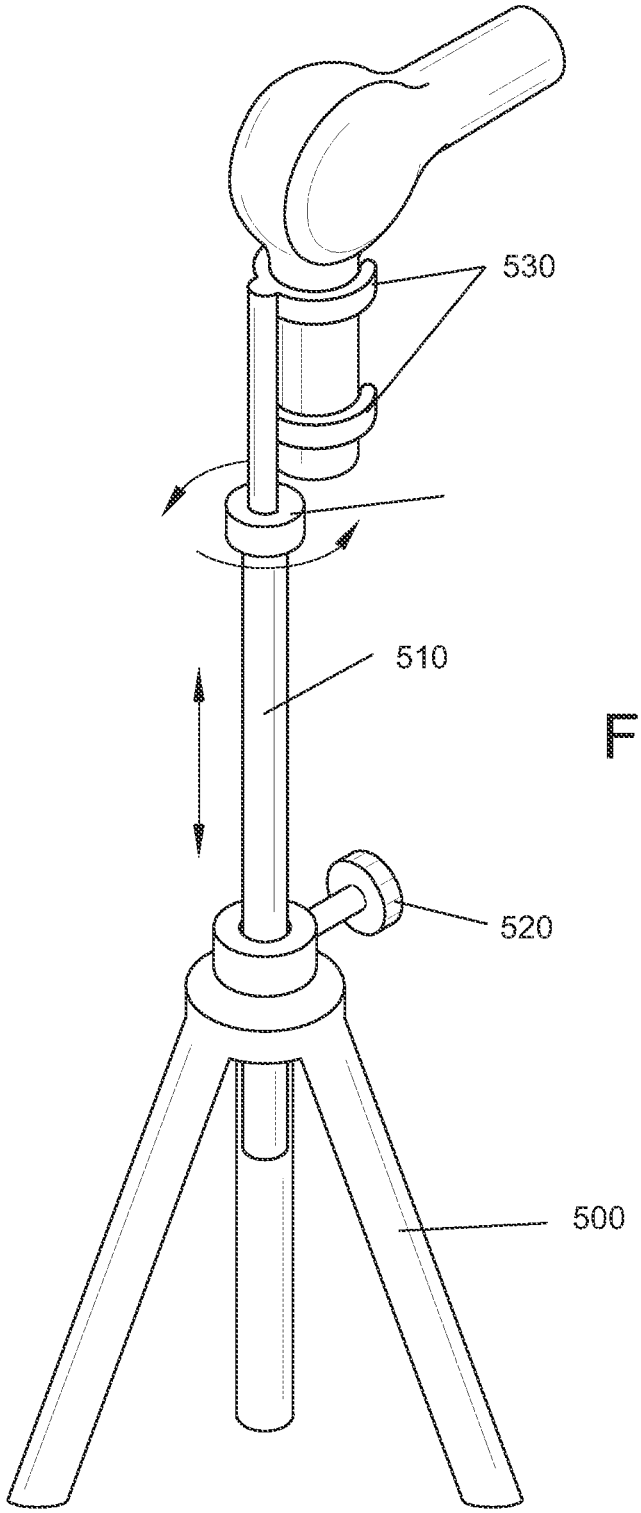
FIG. 8 shows an isometric view of the blower on a tripod.
Figure 9:
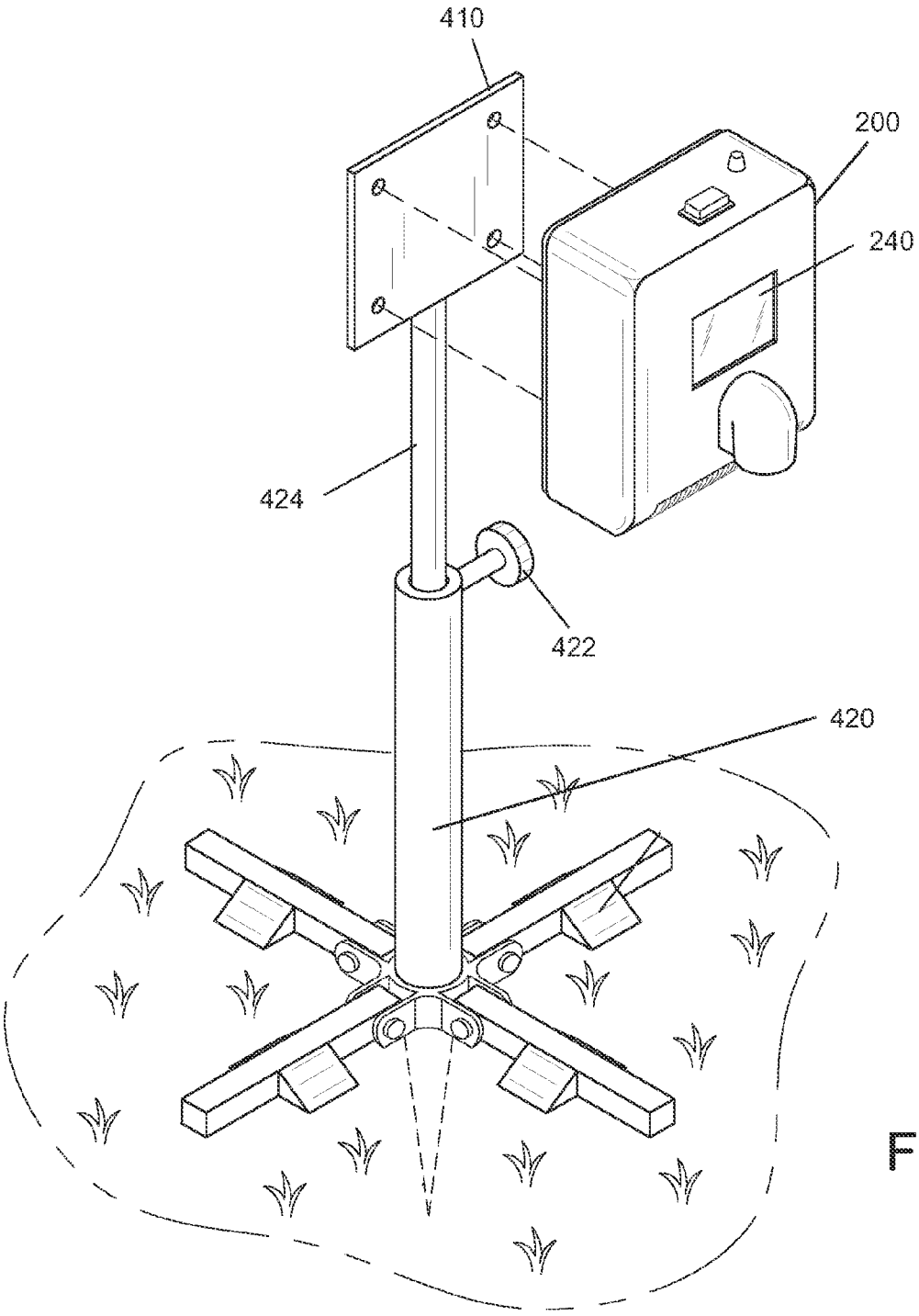
FIG. 9 shows an isometric view of the handy dryer mounted on a telescoping pole.
Figure 10:
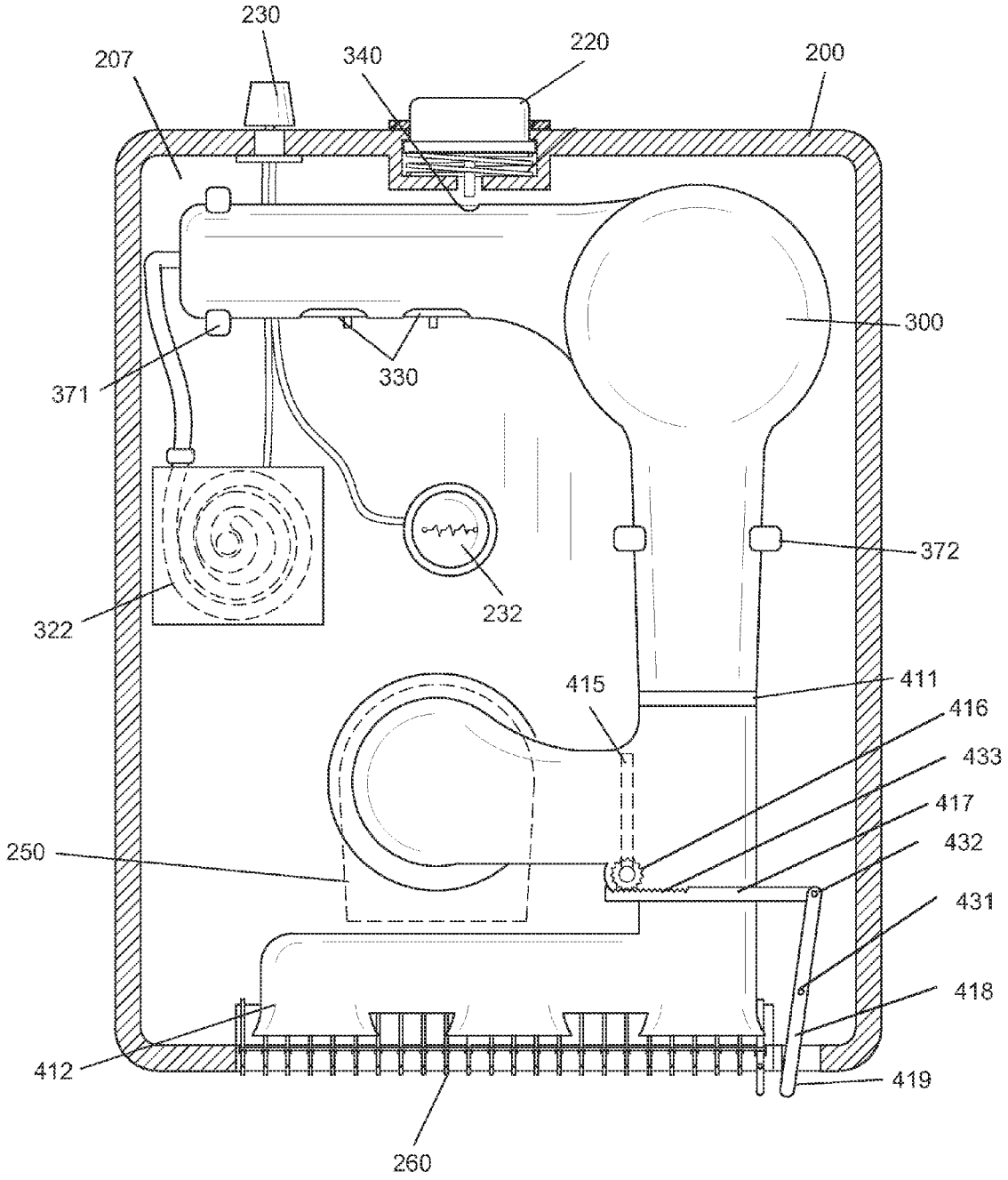
FIG. 10 shows an alternative cross-section view of the handy dryer from back.

Referring now to FIG. 1-10, the present invention features a handy dryer (100). The handy dryer comprises a cover (200) and a back panel (206) mountable to a wall or pole. Within the housing are an L-shaped blower (300), an air divider (410), a blower spout (250) and an adjustable vent (260).

The cover (200) has a top side (201), a lower side (202), a front side (203), a first side (204) and a second side (205), wherein the cover has an interior space (207), wherein an adjustable deflector vent (260) with a vent adjust level (262) is disposed on the lower side (202), wherein an air inlet (270) is disposed on the first side (204), wherein a blower spout (250) is rotatably disposed on the front side (203), wherein a timer button (220) is disposed on the top side (201) of the cover.

The cover (200) is pivotably connected to the back panel (206) via a spring loaded arm (210); wherein the spring loaded arm (210) has a first arm end (211) and a second arm end (212), wherein the first arm end (211) is connected to the top side (201) and the second arm side (212) connected to the back panel (206).

The L-shaped blower (300) has a first arm (301*a*) with a first distal end (302) and second arm (301*b*) with a second distal end (304), wherein the first distal end (302) is configured for air output and the second distal end (304) is a cavity configured to receive a battery (350), wherein an end cap (320) is removably connected to the second distal end (304) of the blower (300), wherein a charge lead (322) is disposed on the end cap (320), wherein the charge lead is operatively connected to the battery (350), wherein the blower comprises an activator (340) which is configured to energize the blower for a predetermined time period once being pressed, wherein the timer button (220) is configured to momentarily engage the activator (340) and thus energize the blower when the time button (220) is pressed, wherein the blower (300) is removably secured to the cover (200) within interior space (207) via at least a first clamp (372) and a second clamp (372), wherein the first clamp (372) and second clamp (372) are mounted on the cover (200) within interior space (207), wherein the first arm (301*a*) is secured by the first clamp (372) and the second arm (301*b*) is secured by the second clamp (374).

The air divider (410) has an inlet opening (411), a first outlet opening (412) and a second outlet opening (413), wherein the first outlet opening (412) and second outlet opening (413) are both fluidly connected to the inlet opening (411), wherein the inlet opening (411) is snugly and sealably connected to the first distal end (312) of the blower, wherein the first inlet opening (412) is facing downwardly toward the lower side (202) of the cover (200) and connected to the adjustable deflector vent (260), wherein the second outlet opening (413) is facing toward the front side (203) of the cover (200) and is connected to the blower spout (250), wherein the air divider (410) has a built-in damper (415) to adjust air flow distribution between the first outlet opening (412) and second outlet opening (413).

In some embodiments, the position of the damper (415) is adjusted by a damper level (419) disposed on the lower side (202) of the cover (200) via a teethed gear (416), a first damper connection rod (417) and second damper connection rod (418), wherein the damper (415) is coaxially connected to the teethed gear (416) and movable between a first position and a second position, wherein the fluid connection of the first outlet opening to the inlet opening is blocked when the damper is in the first position, wherein the fluid connection of the second outlet opening to the inlet opening is blocked when the damper is in the second position, wherein the distal end of the second damper connection rod (418) is functioned as the damper level (419), wherein the second damper connection rod (418) is pivotably attached to the cover (200) within the interior space (207) via a first pivot joint (431) securely mounted on the cover (200) within interior space (207), wherein the first damper connection rod (417) and second damper connection rod (418) are pivotably connected via a second pivot joint (432), wherein a linear teeth is disposed on the distal end of the first damper connection rod (417) to engage the teethed gear (416) such that when the damper level (419) is moved, the proximal end of the second damper connection rod (418) pushes or pulls the first damper connection rod (417), the linear teeth (433) causes the teethed gear (416) to rotate the damper (415) to adjust flow distribution between the first outlet opening and second outlet opening.

In some embodiments, the blower (300) further comprises a plurality of controls (330) for the controlling of the blower such as temperature control, air flow speed control.

In some embodiments, a power adapter jack (370) is disposed on the second side (205) of the cover (200) for the connection of an external power adapter (375), wherein the adapter jack (370) is operatively connected to the charge lead (322) on the end cap (320).

In some embodiments, a dimmer knob (230) is disposed on the top side (201) of the cover (200), wherein the dimmer knob (230) is operatively connected to the power adapter jack (370) and to a lamp (232) via electrical wires (234), wherein the lamp (232) is disposed on the back panel (206), wherein dimmer knob (230) is configured to adjust the light intensity of the lamp (232); wherein the light if the lamp (232) is visible through a frosted window (240) disposed on the front side (203) of the cover (200).

In some embodiments, an activation sensor (356) is disposed on the lower side (202) of the cover, wherein the activation sensor (356) is operatively connected to the blower (300) and is configured to detect hand motion, wherein if hand motion detected, the activation sensor (356) energizes the blower. The activation sensor (356) can be an infrared motion sensor. Infrared motion sensors are well known to one of ordinary art in the field.

In some embodiments, the handy dryer further comprises an additional battery (352) and an external battery charger (354).

In some embodiments, the back panel is mountable to a wall (400) via a plurality of screws (209). In some embodiments, the back panel (206) is mountable to a wall a plate (410), wherein the plate (410) is disposed on a telescoping pole (424) sitting on support platform (420), wherein the height of the plate (410) is adjustable and secured by an adjustment knob (422). Such configuration would enable the handy dryer to be placed on places where power supply is not available, such as remote camping or BBQ sites.

In some embodiments, the blower (300) can be taken out from the handy dryer (100) and be used independently. In some embodiments, the blower (300) can be mounted on a telescoping pole (510) of a tripod (500). The height of the blower (300) can be adjustable and secured by an adjustment knob (520) on the tripod. The blower is secured to the telescoping pole (510) via a plurality of snap-in holder (530).

The disclosures of the following U.S. Patents are incorporated in their entirety by reference herein U.S. Pat. No. 6,848,751, U.S. Pat. No. 5,286,092, U.S. Pat. No. 8,020,954, U.S. Pat. No. 4,441,762, U.S. Pat. No. 5,152,584, U.S. Pat. No. 7,314,254, US patent application publication 2007/0052280.

Various modifications of the invention. In addition to those described herein, will be apparent to those skilled in the art from the foregoing description. Such modifications are also intended to fall within the scope of the appended claims. Each reference cited in the present application is incorporated herein by reference in its entirety.

Although there has been shown and described the preferred embodiment of the present invention, it will be readily apparent to those skilled in the art that modifications may be made thereto which do not exceed the scope of the appended claims. Therefore, the scope of the invention is only to be limited by the following claims.

The reference numbers recited in the below claims are solely for ease of examination of this patent application, and are exemplary, and are not intended in any way to limit the scope of the claims to the particular features having the corresponding reference numbers in the drawings.

What is claimed is:

1. A handy dryer (100) with twin adjustable air vents, wherein the handy dryer comprises:

(a) a cover (200) having a top side (201), a lower side (202), a front side (203), a first side (204) and a second side (205), wherein the cover has an interior space (207), wherein an adjustable deflector vent (260) with a vent adjust level (262) is disposed on the lower side (202), wherein an air inlet (270) is disposed on the first side (204), wherein a blower spout (250) is rotatably disposed on the front side (203), wherein a timer button (220) is disposed on the top side (201) of the cover;

(b) a back panel (206) for mounting the handy dryer, wherein the cover (200) is pivotably connected to the back panel (206) via a spring loaded arm (210); wherein the spring loaded arm (210) has a first arm end (211) and a second arm end (212), wherein the first arm end (211) is connected to the top side (201) and the second arm side (212) connected to the back panel (206);

(c) an L-shaped blower (300) having a first arm (301*a*) with a first distal end (302) and second arm (301*b*) with a second distal end (304), wherein the first distal end (302) is configured for air output and the second distal end (304) is a cavity configured to receive a battery (350), wherein an end cap (320) is removably connected to the second distal end (304) of the blower (300), wherein a charge lead (322) is disposed on the end cap (320), wherein the charge lead is operatively connected to the battery (350), wherein the blower comprises an activator (340) which is configured to energize the blower for a predetermined time period once being pressed, wherein the timer button (220) is configured to momentarily engage the activator (340) and thus energize the blower when the timer button (220) is pressed, wherein the blower (300) is removably secured to the cover (200) within interior space (207) via at least a first clamp (372) and a second clamp (372), wherein the first clamp (372) and second clamp (372) are mounted on the cover (200) within interior space (207), wherein the first arm (301*a*) is secured by the first clamp (372) and the second arm (301*b*) is secured by the second clamp (374); and (d) an air divider (410) having an inlet opening (411), a first outlet opening (412) and a second outlet opening (413), wherein the first outlet opening (412) and second outlet opening (413) are both fluidly connected to the inlet opening (411), wherein the inlet opening (411) is snugly and sealably connected to the first distal end (312) of the blower, wherein the first inlet opening (412) is facing downwardly toward the lower side (202) of the cover (200) and connected to the adjustable deflector vent (260), wherein the second outlet opening (413) is facing toward the front side (203) of the cover (200) and is connected to the blower spout (250), wherein the air divider (410) has a built-in damper (415) to adjust air flow distribution between the first outlet opening (412) and second outlet opening (413).

2. The handy dryer of claim 1, wherein the position of the damper (415) is adjusted by a damper level (419) disposed on the lower side (202) of the cover (200) via a teethed gear (416), a first damper connection rod (417) and second damper connection rod (418), wherein the damper (415) is coaxially connected to the teethed gear (416) and movable between a first position and a second position, wherein the fluid connection of the first outlet opening to the inlet opening is blocked when the damper is in the first position, wherein the fluid connection of the second outlet opening to the inlet opening is blocked when the damper is in the second position, wherein the distal end of the second damper connection rod (418) is functioned as the damper level (419), wherein the second damper connection rod (418) is pivotably attached to the cover (200) within the interior space (207) via a first pivot joint (431) securely mounted on the cover (200) within interior space (207), wherein the first damper connection rod (417) and second damper connection rod (418) are pivotably connected via a second pivot joint (432), wherein linear teeth are disposed on the distal end of the first damper connection rod (417) to engage the teethed gear (416) such that when the damper level (419) is moved, the proximal end of the second damper connection rod (418) pushes or pulls the first damper connection rod (417), the linear teeth (433) cause the teethed gear (416) to rotate the damper (415) to adjust flow distribution between the first outlet opening and second outlet opening.

3. The handy dryer of claim 1, wherein a power adapter jack (370) is disposed on the second side (205) of the cover (200) for the connection of an external power adapter (375), wherein the adapter jack (370) is operatively connected to the charge lead (322) on the end cap (320).

4. The handy dryer of claim 1, wherein a dimmer knob (230) is disposed on the top side (201) of the cover (200), wherein the dimmer knob (230) is operatively connected to the power adapter jack (370) and to a lamp (232) via electrical wires (234), wherein the lamp (232) is disposed on the back panel (206), wherein dimmer knob (230) is configured to adjust the light intensity of the lamp (232); wherein the light of the lamp (232) is visible through a frosted window (240) disposed on the front side (203) of the cover (200).

5. The handy dryer of claim 1, wherein an activation sensor (356) is disposed on the lower side (202) of the cover wherein the activation sensor (356) is operatively connected to the blower (300) and is configured to detect hand motion, wherein, if hand motion detected, the activation sensor (356) energizes the blower.

6. The handy dryer of claim 1, wherein the handy dryer further comprises an additional battery (352) and an external battery charger (354).

7. The handy dryer of claim 1, wherein the back panel is mountable to a wall (400) via a plurality of screws (209).

8. The handy dryer of claim 1, wherein the back panel (206) is mountable to a plate (410), wherein the plate (410) is disposed on a telescoping pole (424) sitting on a support platform (420), wherein the height of the plate (410) is adjustable and secured by an adjustment knob (422).

* * * * *